US009164451B2

(12) United States Patent
Sato et al.

(10) Patent No.: US 9,164,451 B2
(45) Date of Patent: Oct. 20, 2015

(54) FIXING DEVICE, AND IMAGE FORMING APPARATUS

(71) Applicant: FUJI XEROX CO., LTD., Minato-ku, Tokyo (JP)

(72) Inventors: Hideki Sato, Kanagawa (JP); Shigeyuki Maruhashi, Kanagawa (JP); Jun Sawamura, Kanagawa (JP); Yasuhiro Kato, Kanagawa (JP); Kensuke Ainai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/272,967

(22) Filed: May 8, 2014

(65) Prior Publication Data

US 2015/0110524 A1 Apr. 23, 2015

(30) Foreign Application Priority Data

Oct. 22, 2013 (JP) ..... 2013-218992

(51) Int. Cl.
*G03G 15/16* (2006.01)
*G03G 15/20* (2006.01)
*G03G 15/00* (2006.01)

(52) U.S. Cl.
CPC ..... *G03G 15/2064* (2013.01); *G03G 15/2032* (2013.01); *G03G 15/2035* (2013.01); *G03G 15/2067* (2013.01); *G03G 15/2071* (2013.01); *G03G 15/6579* (2013.01); *G03G 2215/0043* (2013.01); *G03G 2215/00721* (2013.01); *G03G 2215/0145* (2013.01); *G03G 2215/2035* (2013.01); *G03G 2221/1639* (2013.01)

(58) Field of Classification Search
CPC ..... G03G 15/2032; G03G 15/2035; G03G 15/2067; G03G 15/2071; G03G 15/6579; G03G 2215/0043; G03G 2215/00721; G03G 2221/1639
USPC ..... 399/122
See application file for complete search history.

(56) References Cited

U.S. PATENT DOCUMENTS

| | | | | |
|---|---|---|---|---|
| 4,998,121 | A * | 3/1991 | Koh et al. | 347/156 |
| 6,647,215 | B1 * | 11/2003 | Ogle et al. | 399/13 |
| 2005/0089352 | A1 * | 4/2005 | Lee et al. | 399/322 |
| 2005/0191075 | A1 * | 9/2005 | Kimizuka et al. | 399/69 |
| 2005/0201788 | A1 * | 9/2005 | Kubochi et al. | 399/381 |
| 2009/0238618 | A1 * | 9/2009 | Kon et al. | 399/371 |
| 2011/0142516 | A1 * | 6/2011 | Uchida | 399/401 |

FOREIGN PATENT DOCUMENTS

| | | | |
|---|---|---|---|
| JP | 2006-30742 | A | 2/2006 |
| JP | 2008189393 | A * | 8/2008 |

* cited by examiner

*Primary Examiner* — David Gray
*Assistant Examiner* — Tyler Hardman
(74) *Attorney, Agent, or Firm* — Sughrue Mion, PLLC

(57) ABSTRACT

Provided is a fixing device including a fixing member that fixes toner onto a recording material, a pressurizing member that forms a nip portion, through which the recording material passes, between the fixing member and the pressurizing member, a moving member that is disposed to be movable in response to passage of the recording material in a transport path of the recording material which passes through the nip portion, a detection unit that detects a presence or absence of the moving member, a displacement mechanism that changes a position of the pressurizing member with respect to the fixing member, and an attachment/detachment member that is disposed in a detachable manner at a facing position facing the displacement mechanism and comes into contact with the moving member.

12 Claims, 12 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2013-218992 filed Oct. 22, 2013.

BACKGROUND

Technical Field

The present invention relates to a fixing device, and an image forming apparatus.

SUMMARY

According to an aspect of the invention, there is provided a fixing device including:

a fixing member that fixes toner onto a recording material;

a pressurizing member that forms a nip portion, through which the recording material passes, between the fixing member and the pressurizing member;

a moving member that is disposed to be movable in response to passage of the recording material in a transport path of the recording material which passes through the nip portion;

a detection unit that detects a presence or absence of the moving member;

a displacement mechanism that changes a position of the pressurizing member with respect to the fixing member; and an attachment/detachment member that is disposed in a detachable manner at a facing position facing the displacement mechanism and comes into contact with the moving member.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described in detail with reference to the accompanying drawings.

Image Forming Apparatus 1

Figure 1:
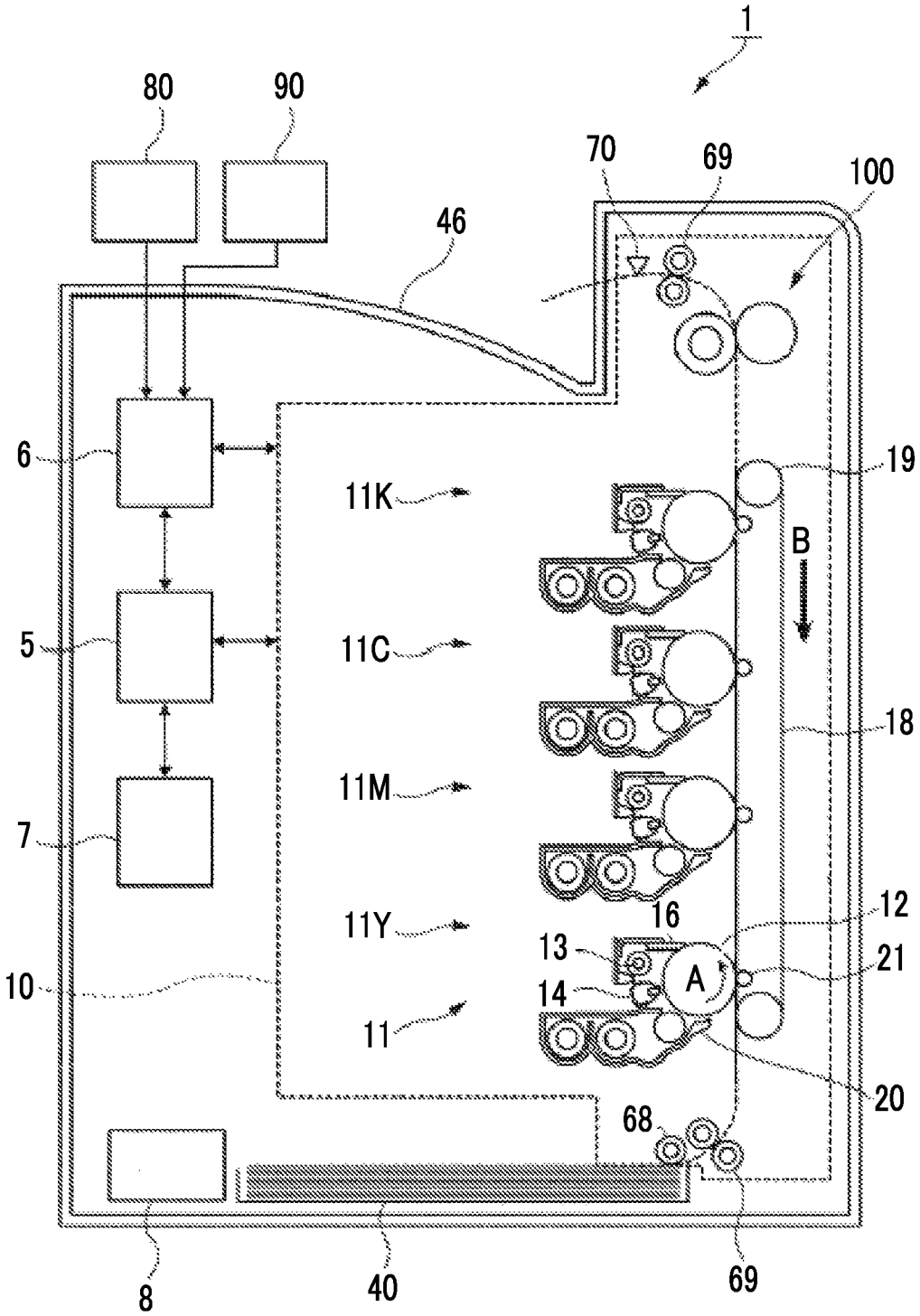
FIG. 1 is a schematic configurational diagram illustrating an image forming apparatus to which an exemplary embodiment of the invention is applied.

FIG. 1 is a schematic configurational diagram illustrating an image forming apparatus 1 to which an exemplary embodiment of the invention is applied.

The image forming apparatus 1 illustrated in FIG. 1 is a so-called tandem type color printer. The image forming apparatus 1 includes an image forming unit 10 that forms images corresponding to image data of respective colors. The image forming apparatus 1 further includes a control unit 5 that controls an operation of the entire image forming apparatus 1, an image processing unit 6 that is connected to external devices such as a personal computer (PC) 80 and an image reader 90 and performs predetermined image processing on the image data received therefrom, and a user interface 7 that receives a command through a user operation. The image forming apparatus 1 further includes a power supply unit 8 that supplies power to each of the units. Furthermore, the image forming apparatus 1 includes a sheet stacking member 40 that stacks sheets (recording materials) which are supplied to the image forming unit 10, and an ejected paper stacking member 46 that stacks the sheets where images are formed by the image forming unit 10.

Image Forming Unit 10

The image forming unit 10, which is an example of a toner image forming unit, is provided with four image forming units 11 (specifically, 11Y, 11M, 11C, and 11K) that are arranged in parallel at predetermined intervals. The image forming unit 10 further has a transport belt 18 that transports the sheets such that toner images of the respective colors, which are formed by the respective image forming units 11, are multi-layer transferred, a driving roller 19 that rotates the transport belt 18, a transfer roller 21 that transfers the toner images of the respective colors which are formed by the respective image forming units 11 onto the sheets, and a fixing device 100 that fixes the transferred toner images of the respective colors onto the sheets.

The image forming unit 10 further has a pickup roller 68 that sequentially feeds the sheets which are stacked on the sheet stacking member 40, a transport path 41 where the sheets that are fed by the pickup roller 68 are transported, and a transport roller 69 that transports the sheets which are fed by the pickup roller 68. The image forming unit 10 further has an exit sensor 70 that detects passage of the sheets where the toner images are fixed by the fixing device 100, and a two-sided transport path 43 that allows two-sided recording by reversing the sheet where the toner image is fixed by the fixing device 100.

The image forming units 11 have photoconductor drums 12 that form electrostatic latent images and hold the toner images, charging units 13 that uniformly charge outer surfaces of the photoconductor drums 12 at a predetermined potential, LED printer heads (LPHs) 14 that expose the photoconductor drums 12 which are charged by the charging units 13 based on the image data, developing devices 20 that develop the electrostatic latent images which are formed on the photoconductor drums 12 by using a developer, and cleaners 16 that clean the outer surfaces of the photoconductor drums 12 after the transfer. In addition, each of the image forming units 11Y, 11M, 11C, and 11K has a substantially similar configuration to each other except for toner that is accommodated in the developing device 20. The image forming units 11Y, 11M, 11C, and 11K respectively form yellow (Y), magenta (M), cyan (C), and black (K) toner images.

Operation of Image Forming Apparatus 1

In the image forming apparatus 1 according to this exemplary embodiment, the image data that is input from the PC 80 and the image reader 90 is sent to the respective image forming units 11 via an interface (not illustrated) after the predetermined image processing is performed by the image processing unit 6. Then, the photoconductor drum 12 is uniformly charged at a predetermined potential by the charging unit 13 while rotating in an arrow A direction in, for example, the image forming unit 11K where the black (K) toner image is formed, and is scanned and exposed by the LPH 14 based on the image data transmitted from the image processing unit 6. In this manner, the electrostatic latent image relating to the black (K) image is formed on the photoconductor drum 12. The electrostatic latent image that is formed on the photoconductor drum 12 is developed by the developing device 20, and the black (K) toner image is formed on the photoconductor drum 12. Likewise, the yellow (Y), the magenta (M), and the cyan (C) toner images are respectively formed on the image forming units 11Y, 11M, and 11C.

The sheets that are stacked on the sheet stacking member 40 are fed by the pickup roller 68. The toner images of the respective colors, which are formed by the respective image forming units 11, are superposed on the sheets that are fed by the pickup roller 68 and being transported by the transport belt 18 which moves in an arrow B direction. The sheets, on which the superposed toner images are electrostatically transferred, are separated from the transport belt 18 and are transported to the fixing device 100. The toner images on the sheets are subjected to fixing processing, using heat and pressure, by the fixing device 100 and are fixed onto the sheets. The sheets, where the fixed images are formed, are further transported by the transport roller 69, are detected by the exit sensor 70, and then are stacked on the ejected paper stacking member 46.

When the two-sided recording is performed on the sheet, the sheet, where the fixed image is formed by the fixing device 100, is transported to the two-sided transport path 43 by the reversed transport roller 69 instead of being ejected onto the ejected paper stacking member 46 as it is. An image is formed, by the image forming unit 10, on the other surface of the sheet that is transported through the two-sided transport path 43 where the fixed image is not formed. In this manner, the images are formed on both of the surfaces of the sheet. Then, the sheet passes through the fixing device 100, the transport roller 69, and the exit sensor 70, and then is stacked on the ejected paper stacking member 46.

Configuration of Fixing Device 100

Figure 2:
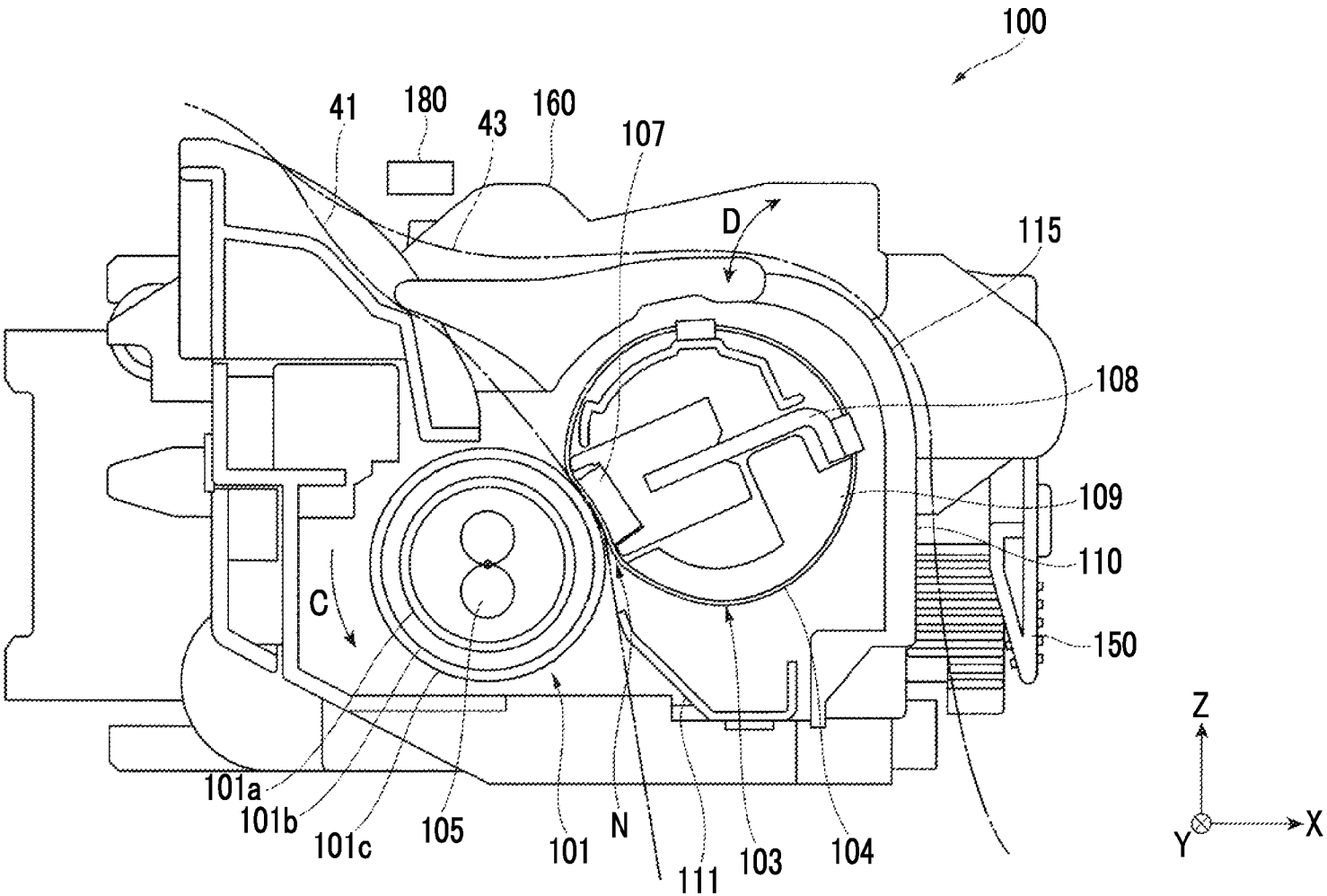
FIG. 2 is a schematic configurational diagram of a fixing device to which the exemplary embodiment of the invention is applied.
Figure 3:
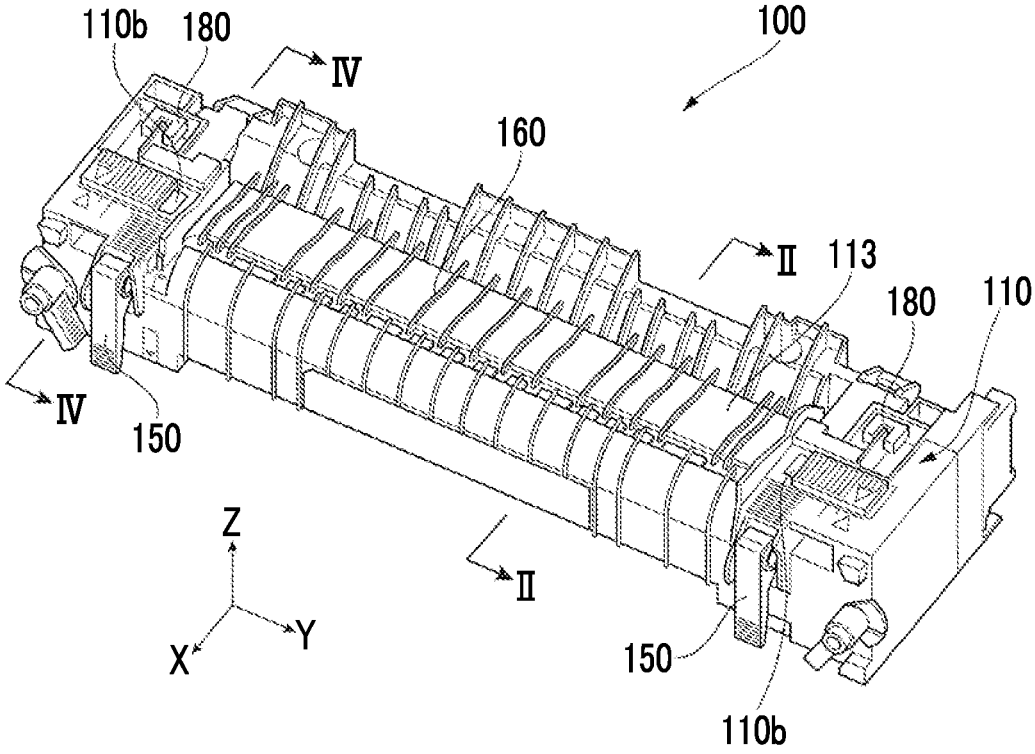
FIG. 3 is a perspective view of the fixing device to which the exemplary embodiment of the invention is applied.
Figure 4:
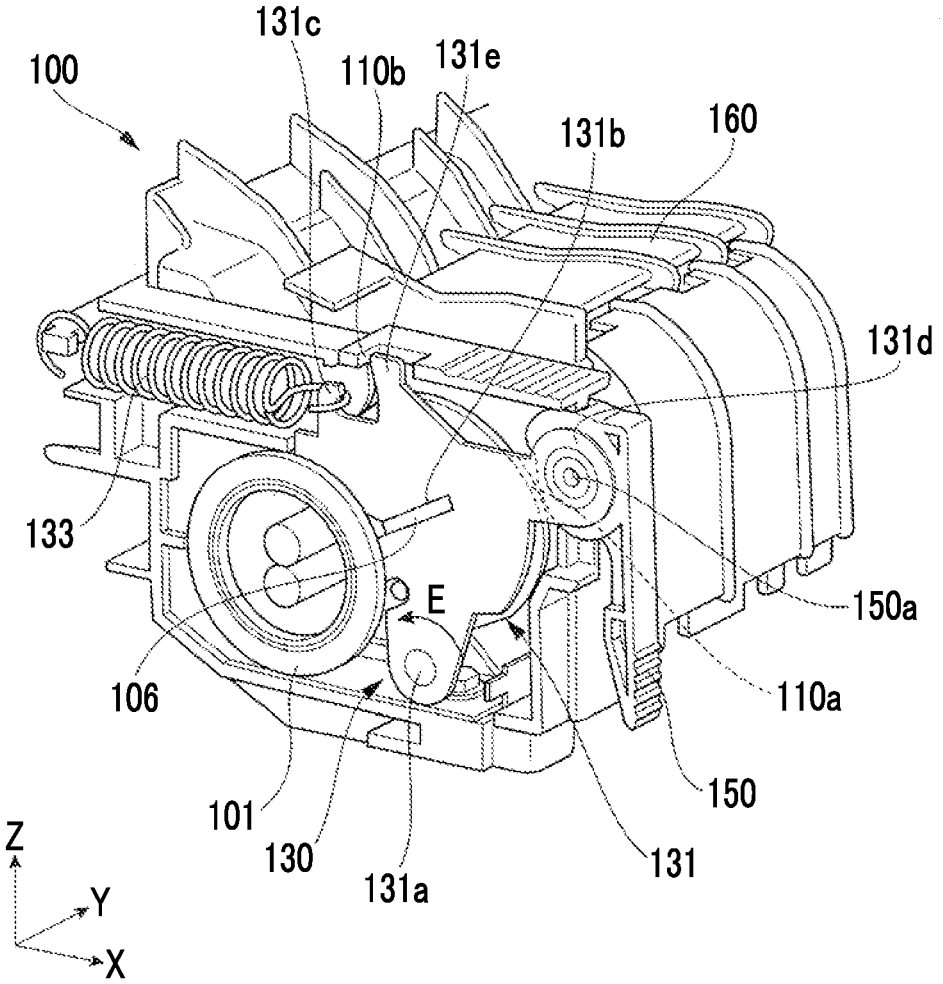
FIG. 4 is a schematic configurational diagram of the vicinity of a biasing portion of the fixing device to which the exemplary embodiment of the invention is applied.

FIG. 2 is a schematic configurational diagram of the fixing device 100 to which the exemplary embodiment of the invention is applied. FIG. 3 is a perspective view of the fixing device 100 to which the exemplary embodiment of the invention is applied. FIG. 4 is a schematic configurational diagram of the vicinity of a biasing portion 130 of the fixing device 100 to which the exemplary embodiment of the invention is applied. FIG. 2 is a schematic configurational diagram taken along cross section II of FIG. 3, and FIG. 4 is a schematic configurational diagram taken along cross section IV of FIG. 3.

As illustrated in FIG. 2, the fixing device 100 according to this exemplary embodiment has a fixing roller 101 that fixes the toner image which is formed on the sheet, a pressurizing belt 103 that is arranged to face the fixing roller 101, a housing 110 that has each functional member disposed therein, the biasing portion 130 (refer to FIG. 4) that forms a nip portion N by biasing the pressurizing belt 103 with respect to the fixing roller 101, a release lever 150 that allows an urging force (nip pressure) of the nip portion N to be released, a switching gate 160 that switches a transport destination of the sheet, and a gate sensor 180 that detects a position of the switching gate 160.

The fixing device 100 according to the illustrated example further has a fixing inlet port guide 111 that guides the sheet toward the nip portion N on a further upstream side than the nip portion N in a sheet transport direction, and a two-sided transport guide 115 that is disposed on an outer circumference of the housing 110 to constitute a part of the two-sided transport path 43.

In the following description, a depth direction in FIG. 2 (direction along an axial direction of the fixing roller 101) is a Y direction, a horizontal direction (left-right direction in the drawing) that is orthogonal to the Y direction is an X direction, and a vertical direction (up-down direction in the drawing) that is orthogonal to the X direction and the Y direction is a Z direction. In FIG. 2, a direction toward a right side in the X direction is a +X direction, a direction toward a far side on a page face in the Y direction is a +Y direction, and a direction toward an upper side of the page face in the Z direction is a +Z direction.

Fixing Roller 101

As illustrated in FIG. 2, the fixing roller 101, which is an example of a fixing member, is a cylindrical roller in which a heat-resistant elastomer layer 101*b* formed of rubber or the like and a release layer 101*c* formed of fluororubber or the like are stacked in the vicinity of a metallic cylindrical core 101*a* formed of aluminum or the like.

The fixing roller 101 has a halogen lamp 105 inside as a heat source, and a temperature sensor (not illustrated) that is disposed in contact with an outer circumferential surface of the release layer 101*c*. In addition, the fixing roller 101 is disposed to be connected to a drive motor (not illustrated).

Pressurizing Belt 103

As illustrated in FIG. 2, the pressurizing belt 103, which is an example of a pressurizing member, has a pressurizing belt main body 104, a pressing pad 107 that is arranged in the pressurizing belt main body 104, a pad holder 108 that holds the pressing pad 107 in the pressurizing belt main body 104, and a belt guide member 109 that supports the pressurizing belt main body 104 from an inner portion of the pressurizing belt main body 104.

The pressurizing belt main body 104 is formed of a seamless endless belt, which is formed to have a cylindrical original shape, such that no defect attributable to a seam is generated in the image that is formed. The pressurizing belt main body 104 is configured to have a single layer that is obtained by, for example, blending a fluorine resin and a reinforcing filler with each other.

The pressing pad 107 is formed of an elastomer such as silicone rubber and fluororubber. The pressing pad 107 has a low-friction sheet (not illustrated) on a surface where the pressing pad 107 and the pressurizing belt main body 104 come into contact with each other so as to reduce sliding resistance between an inner circumferential surface of the pressurizing belt main body 104 and the pressing pad 107.

The pad holder 108 is formed, for example, of a metallic planar member. In the pressurizing belt main body 104, the pad holder 108 holds the pressing pad 107 at a position where the pressing pad 107 faces the fixing roller 101 via the pressurizing belt main body 104.

The belt guide member 109 is formed, for example, of a resin member, and supports the pressurizing belt main body 104 from the inner portion of the pressurizing belt main body 104 to allow a rotary motion.

The pressurizing belt 103 is arranged such that the pressurizing belt main body 104 is pressed to be in contact with the fixing roller 101 via the biasing portion 130 (described later). When the pressurizing belt main body 104 is pressed to be in contact with the fixing roller 101, the pressing pad 107 of the pressurizing belt main body 104 is pressed to the fixing roller 101 via the pressurizing belt main body 104.

Operations of Fixing Roller 101 and Pressurizing Belt 103

In this configuration, the fixing roller 101 rotates (refer to an arrow C) in response to driving of a drive motor (not illustrated), and the pressurizing belt 103 is also in a rotary motion being driven by the rotation. The sheet, where the toner image is electrostatically transferred by the image forming unit 10 (refer to FIG. 1), is transported toward the nip portion N while being guided by the fixing inlet port guide 111. Then, the toner image on the sheet is fixed onto the sheet, when the toner image passes through the nip portion N, by the pressure acting on the nip portion N and the heat supplied from the fixing roller 101. Then, the sheet, where the image is fixed, is transported toward the transport roller 69.

Housing 110

As illustrated in FIG. 3, the housing 110 is configured to have a shape of a substantially oblong member, and a longitudinal direction of which is along the Y direction. The above-described functional members such as the fixing roller 101 and the pressurizing belt 103 are arranged in the housing 110.

The biasing portion 130 (refer to FIG. 4) is disposed in each of both end sides of the housing 110 in the Y direction. In addition, the release lever 150 and the gate sensor 180 are disposed out of the respective end sides of the housing 110 in the Y direction.

Furthermore, an insertion port 110*b*, into which a shim 190 (described later) is inserted, is formed on a surface of the housing 110 directed in the +Z direction and on each of the respective end sides in the Y direction.

Biasing Portion 130

As illustrated in FIG. 4, the biasing portion 130 is disposed in each of end portions of the pressurizing belt 103 in the Y direction. In the illustrated example, the biasing portion 130 holds a claw portion 106 that is a part of the pressurizing belt 103 and is disposed in the end portion of the pressurizing belt 103.

The biasing portion 130 has a lever nip 131 that holds the pressurizing belt 103 and is disposed to be capable of moving back and forth with respect to the fixing roller 101, and a spring 133 that biases the lever nip 131.

The lever nip 131, which is an example of a displacement mechanism, is, for example, a metallic planar member. The lever nip 131 has a rotating shaft 131*a*, a holder groove 131*b* into which the claw portion 106 of the pressurizing belt 103 is inserted, a spring protrusion 131*c* that is a protrusion where one end of the spring 133 is hooked, a release lever hole 131*d* that supports a rotating shaft 150*a* (described later) of the release lever 150 in a rotatable manner, and a shim protrusion 131*e* that is engaged with the shim 190 (described later).

Herein, the spring protrusion 131*c* of the lever nip 131 is biased in a −X direction in response to an elastic force of the spring 133. The biased lever nip 131 rotates (refer to arrow E) about the rotating shaft 131*a*, and presses the claw portion 106, which is inserted into the holder groove 131*b*, toward the fixing roller 101 side. In this manner, the biasing portion 130 presses the pressurizing belt 103 to the fixing roller 101.

Release Lever 150

Figure 5A:
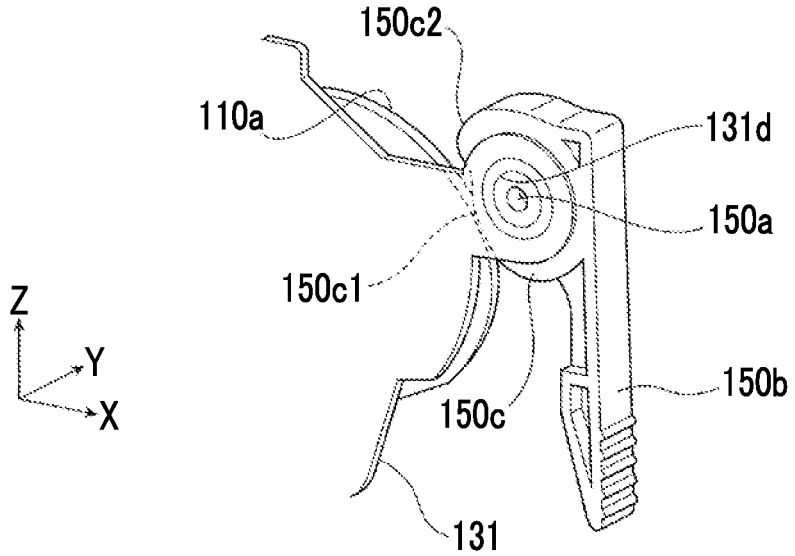
FIG. 5A is a schematic configurational diagram illustrating a release lever.
Figure 5B:
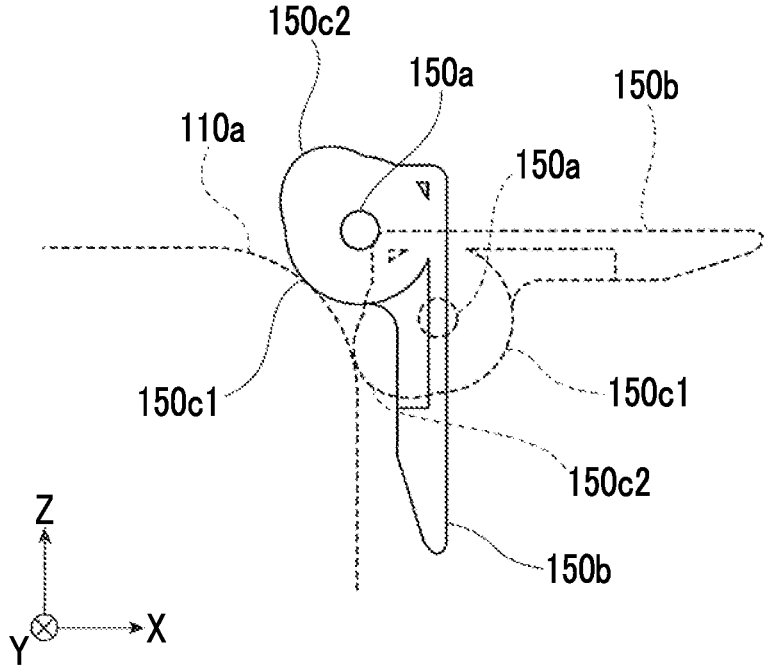
FIG. 5B is an explanatory diagram illustrating the arrangement of the release lever.
Figure 6:
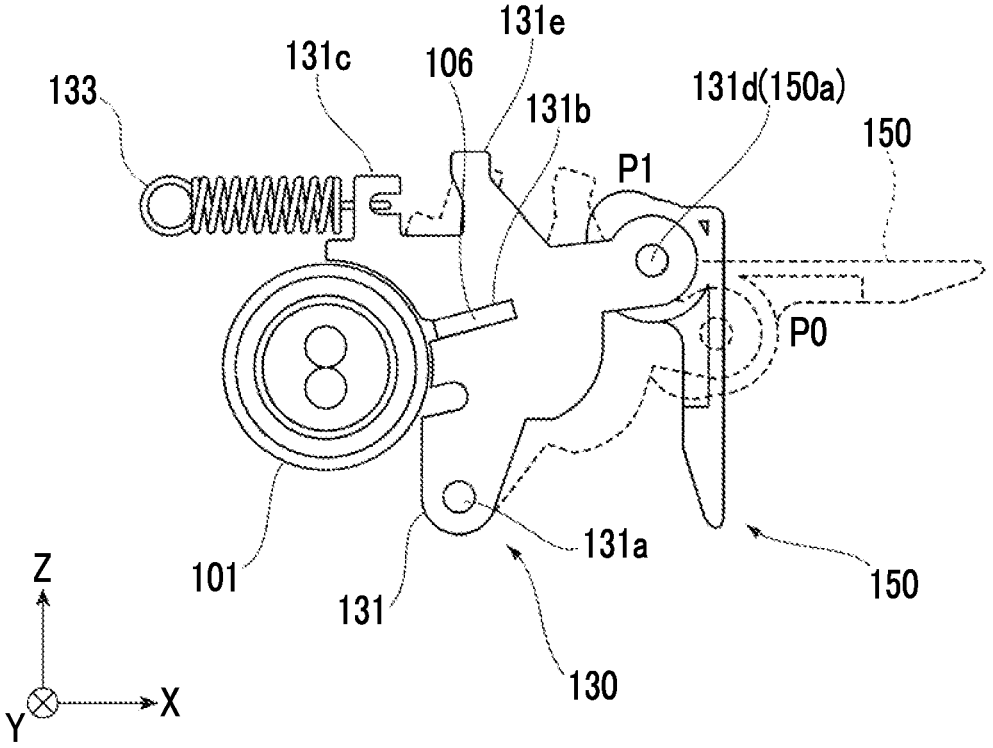
FIG. 6 is an explanatory diagram illustrating an operation of the release lever.

FIG. 5A is a schematic configurational diagram illustrating the release lever 150, and FIG. 5B is an explanatory diagram illustrating the arrangement of the release lever 150. FIG. 6 is an explanatory diagram illustrating an operation of the release lever 150.

As illustrated in FIG. 5A, the release lever 150 has the rotating shaft 150*a*, a lever main body 150*b* that is disposed to be capable of rotating about the rotating shaft 150*a*, and a cam 150*c* that is disposed in the vicinity of the rotating shaft 150*a*. The cam 150*c* has a base circle 150*c*1 and a cam nose 150*c*2.

Herein, the rotating shaft 150*a* of the release lever 150 is supported in a rotatable manner by the release lever hole 131*d* of the lever nip 131. In addition, the cam 150*c* of the release lever 150 is arranged to abut against an abutted portion 110*a* disposed in the housing 110. An area of the cam 150*c* that is in contact with the abutted portion 110*a* is changed as the release lever 150 rotates about the rotating shaft 150*a*.

Specifically, the base circle 150*c*1 of the cam 150*c* contacts with the abutted portion 110*a*, as illustrated in FIG. 5B, at a normal position (refer to the release lever 150 of the solid line) where the release lever 150 is arranged such that the lever main body 150*b* is along the Z direction. In addition, the cam nose 150*c*2 of the cam. 150*c* is in contact with the abutted portion 110*a* at a standing position (refer to the release lever 150 of the dashed line) where the lever main body 150*b* is arranged along the X direction and the release lever 150 is arranged to stand.

When the release lever 150 having this configuration is operated by a user, a posture of the release lever 150 is switched between the normal position and the standing position. Then, as illustrated in FIG. 5B, a position of the rotating shaft 150*a* is changed by the switch in posture of the release lever 150. As a result, a posture of the lever nip 131 that supports the rotating shaft 150*a* is changed, and the nip pressure in the nip portion N is changed.

In other words, in a state where the release lever 150 is at the normal position (refer to the release lever 150 of the solid line) and the lever nip 131 is arranged at a position P1 continuous to the fixing roller 101 as illustrated in FIG. 6, the pressurizing belt 103 is biased with respect to the fixing roller 101 and a predetermined nip pressure is generated in the nip portion N. In a state where the release lever 150 is at the standing position (refer to the release lever 150 of the dashed line) and the lever nip 131 is arranged at a position P0, which is separated more from the fixing roller 101 than the position P1, the pressurizing belt 103 is in a state of being separated from the fixing roller 101 with no nip pressure being generated in the nip portion N.

When the image is formed on the sheet in the image forming apparatus 1 (refer to FIG. 1), the release lever 150 is at the normal position and the sheet that passes through the nip portion N is pressed with a predetermined nip pressure. When, for example, sheet jamming occurs in the fixing device 100, the release lever 150 is allowed to stand, through the operation by the user, to be at the standing position. In this manner, the nip pressure in the nip portion N is released and the sheet may be removed with ease.

Switching Gate 160

Figure 7:
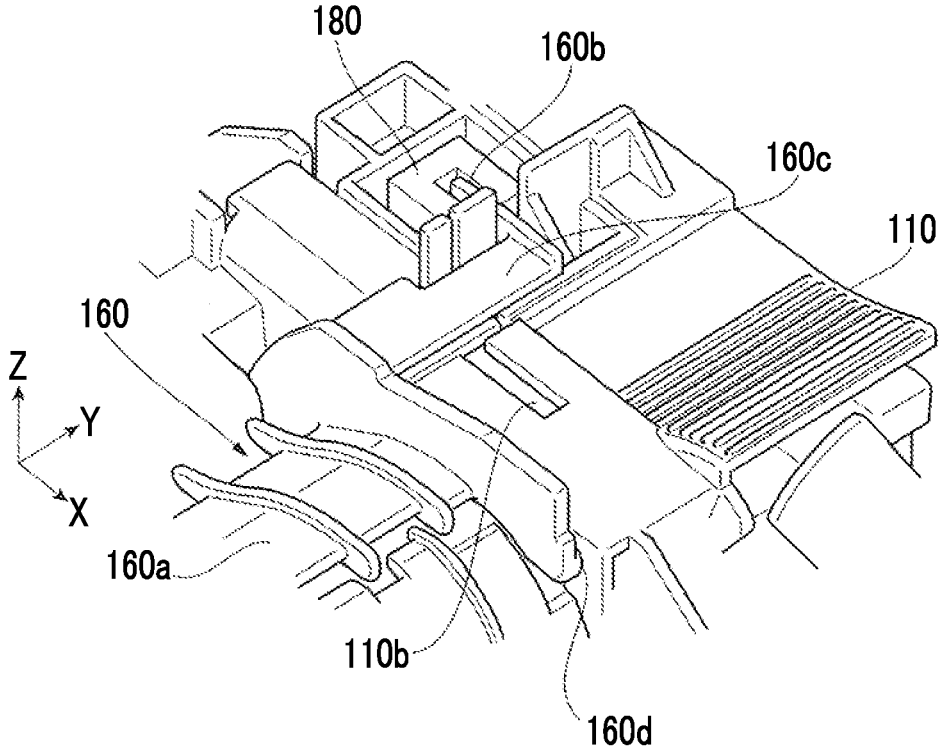
FIG. 7 is a diagram illustrating a +Y side end portion of a switching gate to which the exemplary embodiment of the invention is applied.
Figure 8:
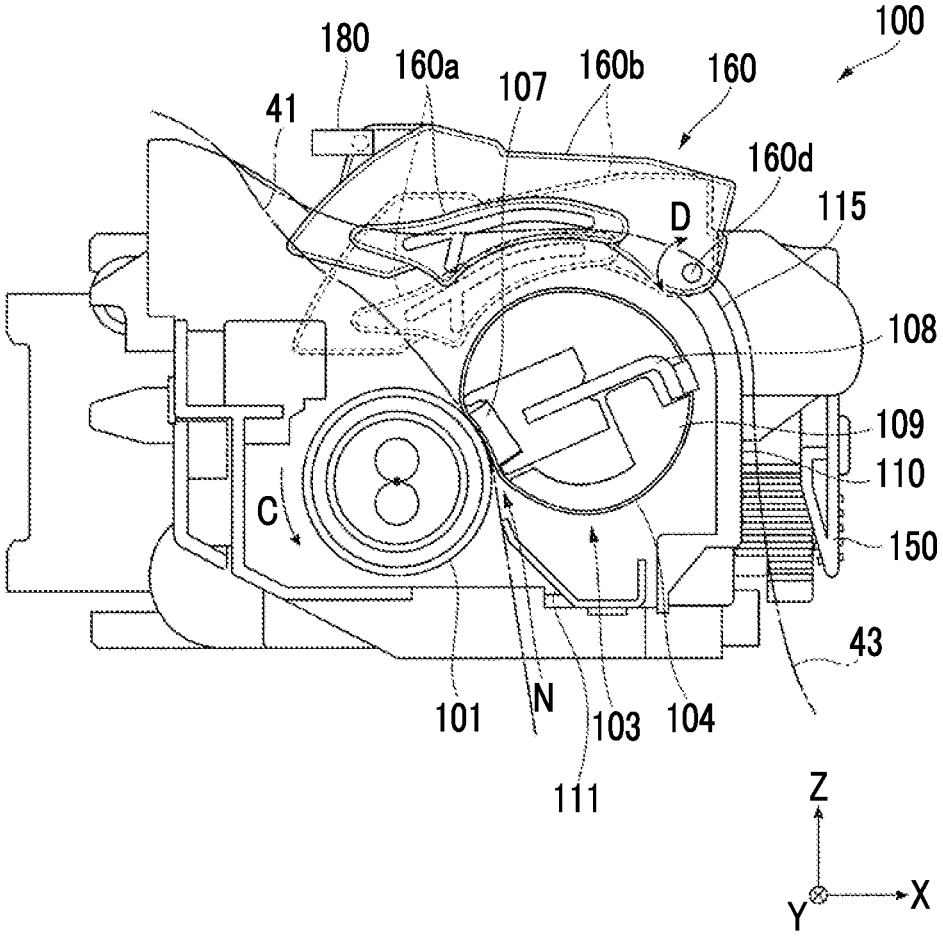
FIG. 8 is an explanatory diagram illustrating an operation of the switching gate.

FIG. 7 is a diagram illustrating a +Y side end portion of the switching gate 160 to which the exemplary embodiment of the invention is applied. FIG. 8 is an explanatory diagram illustrating an operation of the switching gate 160.

As illustrated in FIG. 7, the switching gate 160, which is an example of a moving member, is formed of an elongated planar member of which a longitudinal direction is along the Y direction, and has a gate main body 160*a* that guides the sheet along the transport path 41 or the two-sided transport path 43. The switching gate 160 further has a sensor flag portion (actuator) 160*b* that is a planar member with a normal line along the Y direction and is detected by the gate sensors 180 while being disposed on both end sides of the gate main body 160*a* in the Y direction, a connection portion 160*c* that connects the gate main body 160*a* and the sensor flag portion 160*b* with each other, and a rotating shaft 160*d* that is disposed along the Y direction.

As illustrated in FIG. 8, the switching gate 160 is disposed to be rotatable about the rotating shaft 160*d*, and may be arranged at a first position (refer to the switching gate 160 of the solid line in the drawing) and at a second position (refer to the switching gate 160 of the dashed line in the drawing) where the gate main body 160*a* is positioned more downward than at the first position.

In a state where the switching gate 160 is arranged at the first position, the switching gate 160 guides the sheet, which is transported from the nip portion N along the transport path 41, to a path (first transport path) toward the transport roller 69 (refer to FIG. 1) by an upper surface of the gate main body 160*a*. In addition, in a state where the switching gate 160 is arranged at the second position, the switching gate 160 guides the sheet, which is transported from the transport roller (transport unit) 69, to the two-sided transport path (second transport path) 43 by a lower surface of the gate main body 160*a*.

The switching gate 160 according to the illustrated example, is arranged at the second position, for its own weight, in a normal state and is pushed up by the sheet to be arranged at the first position when the sheet is transported from the nip portion N.

Gate Sensor 180

Figure 9A:
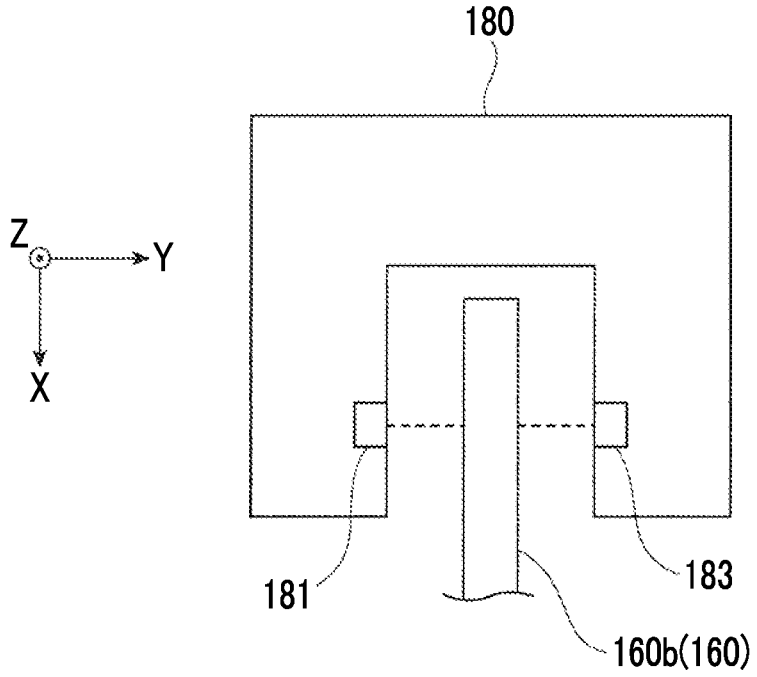
FIG. 9A is a schematic configurational diagram of a gate sensor.
Figure 9B:
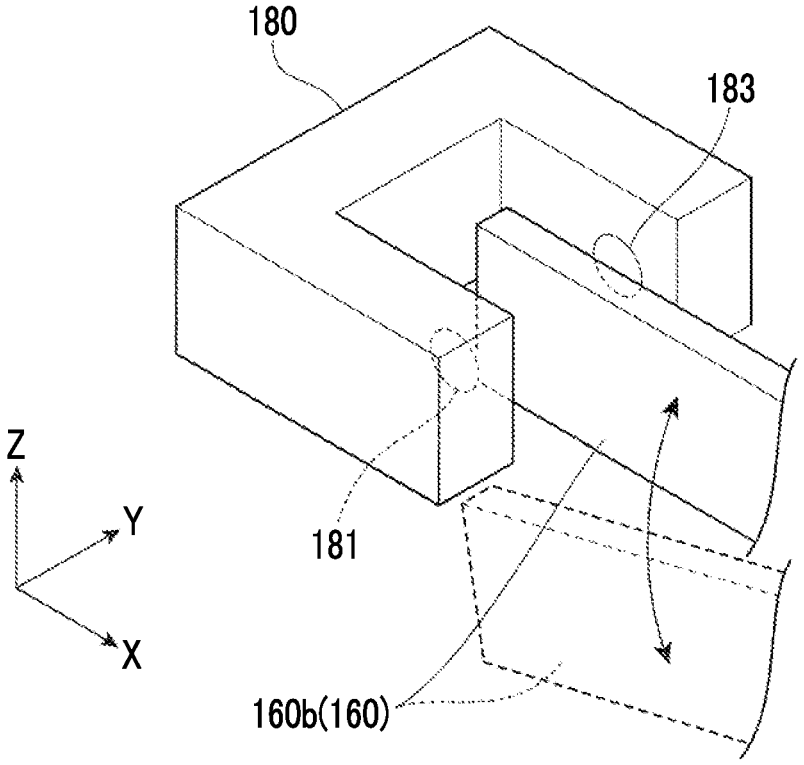
FIG. 9B is an explanatory diagram illustrating a relationship between the gate sensor and a sensor flag portion.

FIG. 9A is a schematic configurational diagram of the gate sensor 180, and FIG. 9B is an explanatory diagram illustrating a relationship between the gate sensor 180 and the sensor flag portion 160*b*.

The gate sensor 180, which is an example of a detection unit, detects a position of the sensor flag portion 160*b* of the switching gate 160. The control unit 5 (refer to FIG. 1) receives a signal from the gate sensor 180. In addition, the control unit 5 detects jamming (transport error) that occurs in the nip portion N based on the signal from the gate sensor 180.

Specifically, the gate sensor 180 is disposed to face an area where the sensor flag portion 160*b* passes as the switching gate 160 rotates about the rotating shaft 160*d* as illustrated in FIG. 8. The gate sensor 180 according to the illustrated example is arranged at a position where the sensor flag portion 160*b* of the switching gate 160 arranged at the first position is detected and the sensor flag portion 160*b* of the switching gate 160 arranged at the second position is not detected.

Upon further description, the gate sensor 180 is disposed to pinch the sensor flag portion 160*b* of the switching gate 160 arranged at the first position from both sides in the Y direction as illustrated in FIG. 9A. An irradiation unit 181 is disposed on one of the sides pinching the sensor flag portion 160*b*, and a light receiving unit 183 is disposed on the other side.

In a state where the switching gate 160 is arranged at the first position (refer to the switching gate 160 of the solid line in the drawing) as illustrated in FIG. 9B, a light beam that is emitted from the irradiation unit 181 is blocked by the sensor flag portion 160*b* and the emitted light beam is not received by the light receiving unit 183. The state where the light receiving unit 183 does not receive the light beam emitted from the irradiation unit 181 is referred to as a non-light receiving state.

In a state where the switching gate 160 is arranged at the second position (refer to the switching gate 160 of the dashed line in the drawing), the light receiving unit 183 receives the light beam emitted from the irradiation unit 181. The state where the light receiving unit 183 receives the light beam emitted from the irradiation unit 181 is referred to as a light receiving state.

A relationship between the presence and absence of the sheet in the nip portion N of the fixing device 100 and a detection state of the gate sensor 180 will be described referring back to FIG. 8.

First, in a state where the sheet is absent in the nip portion N of the fixing device 100, the switching gate 160 is arranged at the second position due to its own weight as described above (refer to the switching gate 160 of the dashed line in the drawing). In this case, the gate sensor 180 is in the light receiving state.

In a state where the sheet is present in the nip portion N of the fixing device 100, the switching gate 160 is lifted by the sheet to be arranged at the first position (refer to the switching gate 160 of the solid line in the drawing). In this case, the gate sensor 180 is in the non-light receiving state.

Herein, considering the passage of the sheet through the nip portion N, the gate sensor 180 is in the light receiving state before the sheet passes through the nip portion N, is in the non-light receiving state during the sheet passes through the nip portion N, and is back in the light receiving state after the sheet passes through the nip portion N. The gate sensor 180 functions as a so-called paper pass sensor using the switch between the light receiving state and the non-light receiving state. In addition, the gate sensor 180 detects a movement of the switching gate 160 so as to detect a sheet transport error.

A duration (reference time) of the non-light receiving state of the gate sensor 180 during the passage of the sheet through the nip portion N is determined by the size of the sheet if the sheet is in a normal transport state. When jamming occurs in the nip portion N to cause a transport error, the non-light receiving state continues for a length of time longer than the reference time.

In this exemplary embodiment, jamming is determined to occur in the nip portion N when the length of time during which the non-light receiving state continues is detected to exceed the reference time determined by the size of the sheet.

For example, when the gate sensor 180 is in the non-light receiving state, the gate sensor 180 outputs a predetermined signal to the control unit 5 (refer to FIG. 1). The control unit 5 that receives the signal counts the length of time during which the signal continues and compares the length of time during which the signal continues to the reference time stored in advance. When the length of time during which the signal continues exceeds the reference time, the control unit 5 stops an image forming operation by the image forming unit 10. In addition, the user interface 7 displays the occurrence of the jamming in the nip portion N. The user recognizes, from the display, that the sheet present in the nip portion N needs to be removed by using the release lever 150 (refer to FIG. 3) or the like.

Shim 190

Figure 10:
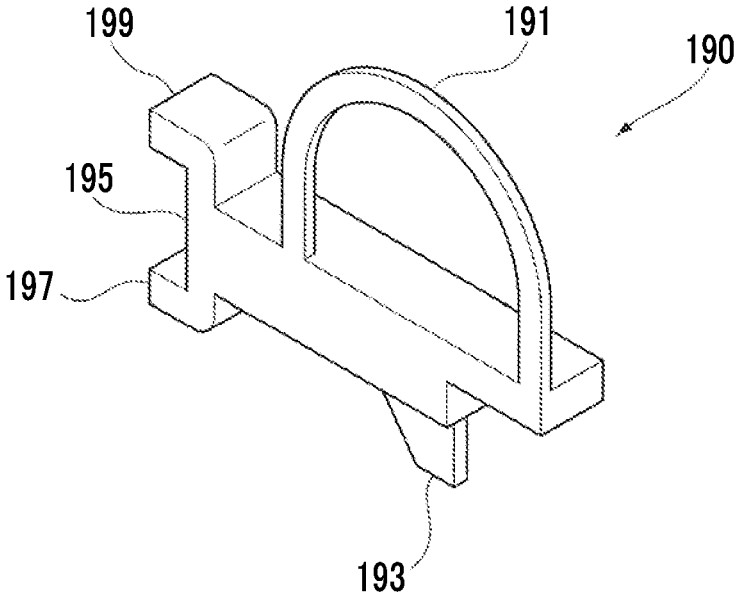
FIG. 10 is a schematic configurational diagram of a shim to which the exemplary embodiment of the invention is applied.
Figure 11:
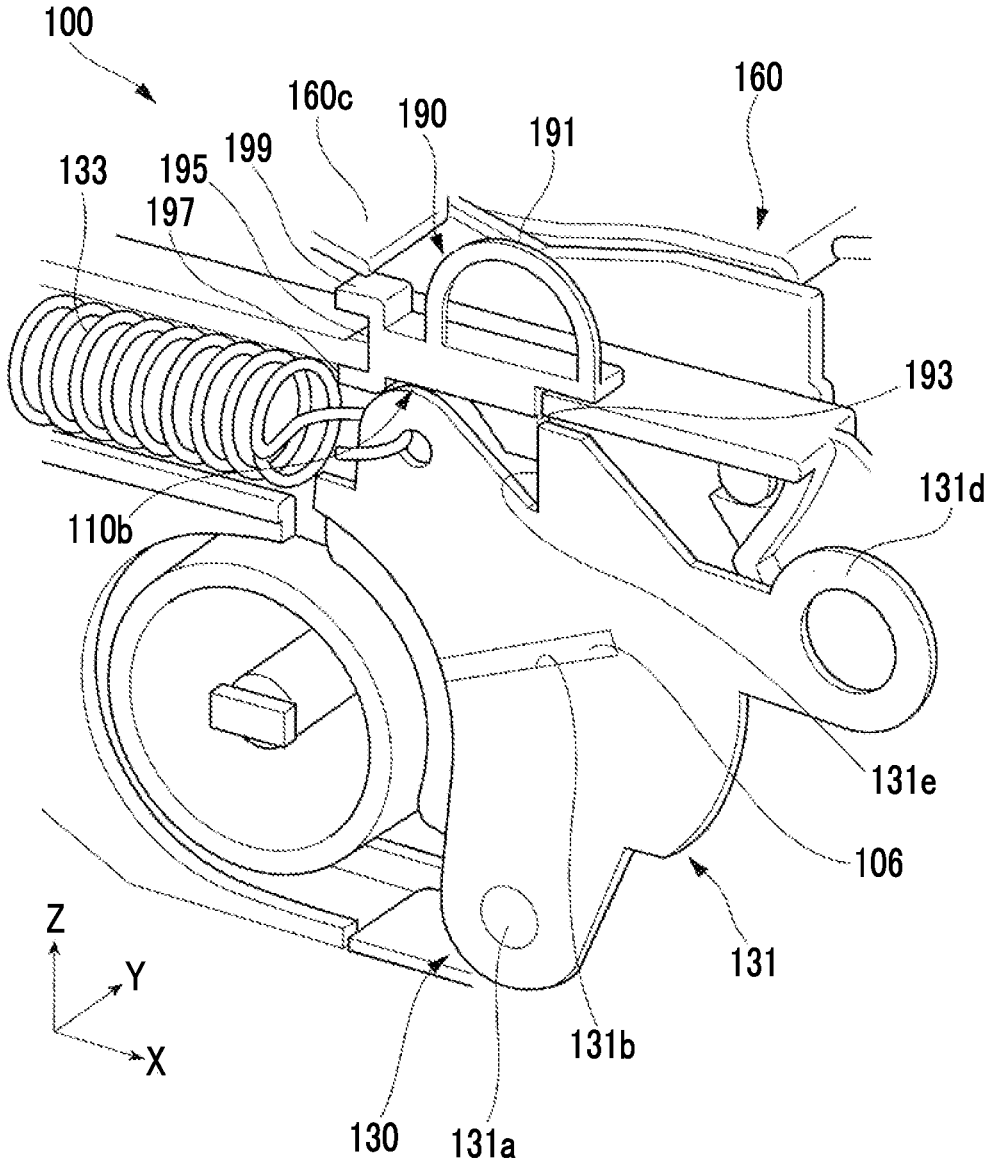
FIG. 11 is an explanatory diagram illustrating a relationship between the shim and the biasing portion.
Figure 12:
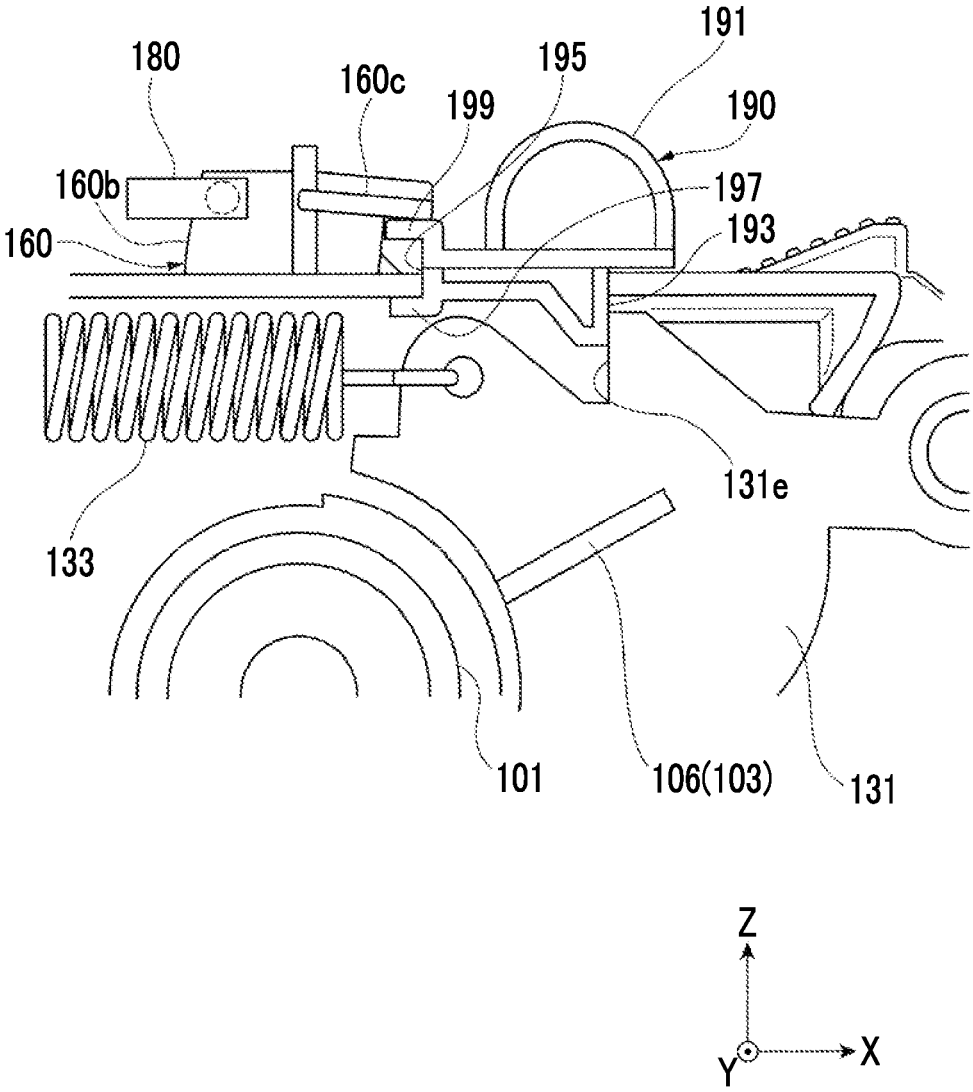
FIG. 12 is an explanatory diagram illustrating a relationship between the shim and the switching gate.

FIG. 10 is a schematic configurational diagram of the shim 190 to which the exemplary embodiment of the invention is applied. FIG. 11 is an explanatory diagram illustrating a relationship between the shim 190 and the biasing portion 130. FIG. 12 is an explanatory diagram illustrating a relationship between the shim 190 and the switching gate 160. For convenience of drawing, the lever nip 131 illustrated in FIGS. 11 and 12 has a partially different shape from that illustrated in FIG. 4 or the like. However, the difference in shape does not change the function of the lever nip 131 described above.

In general, at least one of the fixing roller 101 and the pressurizing belt 103 need to have elasticity so as to ensure an area of the nip portion N of the fixing device 100. In the illustrated example, the area of the nip portion N is ensured by providing elasticity for the pressurizing belt 103 and the pressing pad 107.

Herein, as for the pressing pad 107 for example, the pressing pad 107 is deformed (nip mark remains thereon), at least temporarily, when a state where the pressing pad 107 is pressurized continues. The deformation may result in poor image quality of the image formed on the sheet and periodic noises during the operation of the fixing device 100. In addition, the deformation of the pressing pad 107 is more likely to occur when the state where the pressing pad 107 is pressurized continues, examples of which include cases of storage as service parts and inventory and a case where the fixing device 100 is not used over a long period of time after the fixing device 100 is mounted on the image forming apparatus 1.

In this exemplary embodiment, the shim 190, which may release the nip pressure in the nip portion N with a simple configuration, is used so as to suppress the deformation of the pressing pad 107.

As illustrated in FIG. 10, the shim 190, which is an example of an attachment/detachment member, has a handle 191 that is gripped by the user, a lever nip receiving portion 193 that receives the shim protrusion 131*e* of the lever nip 131, an abutting portion 195 that abuts against an inner circumferential wall of the insertion port 110*b* formed in the housing 110, a claw portion 197 that is engaged with the housing 110, and a gate supporting unit 199 that is arranged outside the housing 110 to support the connection portion 160*c* of the switching gate 160.

The shim 190 is inserted into the insertion port 110*b* of the housing 110. In this manner, the nip pressure in the nip portion N is released.

Describing the release of the nip pressure in the nip portion N by inserting the shim 190 in detail, the user, for example, arranges the release lever 150 at the standing position and arranges the lever nip 131 at the position P0 (refer to FIG. 6). In this manner, the nip pressure in the nip portion N is released.

Then, the shim 190 is inserted into the insertion port 110*b* while the switching gate 160 is arranged at the first position by, for example, lifting the switching gate 160. In further detail, the claw portion 197 and the abutting portion 195 of the shim 190 are inserted into the insertion port 110*b*. In this case, the gate supporting unit 199 of the shim 190 moves toward between the housing 110 and the connection portion 160*c*, and an upper surface of the gate supporting unit 199 of the shim 190 contacts with the connection portion 160*c*.

In this state, the release lever 150 is returned to the normal position. In this case, the lever nip 131 remains to be arranged at the position P0 (refer to FIG. 6), even when the release lever 150 is returned to the normal position, since the shim 190 is arranged as illustrated in FIG. 11. In other words, although the lever nip 131 is to rotate in the arrow E direction (refer to FIG. 4), the shim 190 with the abutting portion 195 abutting against the inner circumferential wall of the insertion port 110*b* supports the shim protrusion 131*e* of the lever nip 131 with the lever nip receiving portion 193 and the rotation of the lever nip 131 is inhibited.

In this manner, the lever nip 131, of which the rotation is limited by the shim 190, is positioned at the position P0, and the state where the nip pressure in the nip portion N is released continues.

In addition, the switching gate 160 is in a state of limited movement due to the shim 190, and thus damage to the switching gate 160 attributable to shaking of the switching gate 160 during the transport and the abnormal noises by the switching gate 160 are reduced.

In addition, in this case, the gate supporting unit 199 of the shim 190 supports the connection portion 160*c* as illustrated in FIG. 12, and thus the switching gate 160 is arranged at the first position and the gate sensor 180 is in the non-light receiving state. In other words, the shim 190 causes the gate sensor 180 to detect a state of the switching gate 160 as a transport error.

When the fixing device 100 is operated, the shim 190 that is arranged in the insertion port 110*b* is removed by the user. When the shim 190 that is arranged in the insertion port 110*b* is removed, the lever nip 131 rotates and moves from the position P0 to the position P1, and the nip pressure is generated in the nip portion N. In addition, the switching gate 160 moves to the second position, and the gate sensor 180 is in the light receiving state.

When the fixing device 100 is operated without the shim 190 arranged in the insertion port 110*b* being removed, the fixing processing is performed in a state where the nip pressure in the nip portion N is released. Accordingly, a fixing failure of the image that is formed on the sheet occurs. Furthermore, the fixing failure may not be recognized as an error.

Therefore, this exemplary embodiment has the following configuration so as to avoid the image formation without the shim 190 being removed.

First, the control unit 5, which is an example of an attachment/detachment recognition unit, an insertion recognition unit, and a determination unit, determines whether or not a predetermined signal that is output from the gate sensor 180 as the gate sensor 180 is in the non-light receiving state is received when power is supplied to the image forming apparatus 1 (or the fixing device 100). In other words, the control unit 5 recognizes an attachment/detachment state of the shim 190 according to a state of the switching gate 160 detected by the gate sensor 180.

Then, the control unit 5 displays an image to suggest the removal of the shim 190 on the user interface 7 when the control unit 5 receives a predetermined signal from the gate sensor 180. In this case, for example, a diagram illustrating a position where the shim 190 to be removed is arranged may be displayed on the user interface 7. The user, from this display, recognizes that the shim 190 needs to be removed. In addition, a paper slip (tag) that shows the necessity of the removal of the shim 190 does not have to be attached in advance to the shim 190 because of the display on the user interface 7. In addition, the control unit 5 and the user interface 7 may be considered as display units.

The image formation may be controlled not to be initiated while the control unit 5 receives a predetermined signal from the gate sensor 180. In this manner, the shim 190 may be reliably removed without being forgotten.

In addition, this exemplary embodiment may be regarded as an aspect in which the removal of the shim 190 is not forgotten since a sheet transport error state (special state where the gate sensor 180 is ON) is formed through the arrangement of the shim 190.

Furthermore, the accuracy of the detection of the sheet transport error after the image formation is initiated and the sheet is transported is improved since it is determined whether or not the control unit 5 receives a predetermined signal output from the gate sensor 180 when the power is supplied to the image forming apparatus 1.

As such, according to the present exemplary embodiment, the fixing device 100 is simplified in structure when compared to a different configuration in which the fixing device 100 itself is provided with an entire mechanism for releasing the nip pressure when the fixing device 100 is not used.

In the case of the configuration in which the fixing device 100 itself is provided with the entire mechanism for releasing the nip pressure when the fixing device 100 is not used, unlike the present exemplary embodiment, a transition is made from the state where the nip pressure is released to the nip state by using, for example, an operation through which the fixing device 100 is inserted into and removed from the image forming apparatus 1.

However, in the present exemplary embodiment, regardless of the operation through which the fixing device 100 is inserted and removed, the transition from the state where the nip pressure is released to the nip state is made by an operation through which the shim 190 is removed. In this manner, in this exemplary embodiment, an operating force of the user is reduced when the operation through which the fixing device 100 is inserted and removed is performed and operability is improved when the fixing device 100 is inserted and removed. In addition, in this exemplary embodiment, the state where the nip pressure is released may be maintained even in a state where the fixing device 100 is mounted on the image forming apparatus 1.

In the above description, the nip portion N is formed by combining the fixing roller 101 and the pressurizing belt 103. However, the exemplary embodiment described above may also be applied to a combination between rollers or a combination between belts.

In addition, a total of two gate sensors 180 are disposed on both of the end sides of the housing 110 in the Y direction in the above description. However, the gate sensor 180 may be configured to be disposed only in one of the end portion sides of the housing 110 in the Y direction. Furthermore, a total of two shims 190 are arranged on both of the end sides of the housing 110 in the Y direction in the above description, but the shim 190 may be configured to be arranged on only one of the end sides of the housing 110.

In the above description, the control unit 5 that is disposed in the image forming apparatus 1 receives a predetermined signal from the gate sensor 180. However, the fixing device 100 may be configured to have a fixing control unit (not illustrated) that controls an operation of the fixing device 100. The fixing control unit detects the non-removal of the shim 190 by receiving a predetermined signal from the gate sensor 180.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that fixes toner onto a recording material;

a pressurizing member that forms a nip portion, through which and the recording material passes between the fixing member and the pressurizing member;

a moving member that is disposed to be movable in response to passage of the recording material in a transport path of the recording material which passes through the nip portion;

a detection unit that detects a presence or absence of the moving member;

a displacement mechanism that changes a position of the pressurizing member with respect to the fixing member;

a housing supporting the displacement mechanism and the moving member; and an attachment/detachment member that is disposed in a detachable manner at a position to contact the displacement mechanism, the housing and the moving member.

2. The fixing device according to claim 1, further comprising:

an attachment/detachment recognition unit that recognizes an attachment/detachment state of the attachment/detachment member according to a state of the moving member which is detected by the detection unit.

3. The fixing device according to claim 1, wherein the attachment/detachment member separates the pressurizing member from the fixing member by the displacement mechanism when the attachment/detachment member is disposed at the facing position and allows the detection unit to detect a state where the recording material is in contact with the moving member.

4. The fixing device according to claim 3, further comprising:

a determination unit that determines whether or not the detection unit detects the state where the recording material is in contact with the moving member when power is supplied to the subject device.

5. The fixing device according to claim 4, further comprising:

a display unit that displays to suggest for removing the attachment/detachment member when the determination unit determines that the detection unit detects the state where the recording material is in contact with the moving member.

6. The fixing device according to claim 1, wherein the moving member guides the recording material to a first transport path toward a transport unit that transports the recording material which is transported from the nip portion, and guides the recording material to a second transport path toward a toner image forming unit that forms a toner image on a surface opposite to a surface of the recording material, where the toner is fixed, which is reversed and transported from the transport unit.

7. The fixing device according to claim 2, wherein the moving member guides the recording material to a first transport path toward a transport unit that transports the recording material which is transported from the nip portion, and guides the recording material to a second transport path toward a toner image forming unit that forms a toner image on a surface opposite to a surface of the recording material, where the toner is fixed, which is reversed and transported from the transport unit.

8. The fixing device according to claim 3, wherein the moving member guides the recording material to a first transport path toward a transport unit that transports the recording material which is transported from the nip portion, and guides the recording material to a second transport path toward a toner image forming unit that forms a toner image on a surface opposite to a surface of the recording material, where the toner is fixed, which is reversed and transported from the transport unit.

9. The fixing device according to claim 4, wherein the moving member guides the recording material to a first transport path toward a transport unit that transports the recording material which is transported from the nip portion, and guides the recording material to a second transport path toward a toner image forming unit that forms a toner image on a surface opposite to a surface of the recording material, where the toner is fixed, which is reversed and transported from the transport unit.

10. The fixing device according to claim 5, wherein the moving member guides the recording material to a first transport path toward a transport unit that transports the recording material which is transported from the nip portion, and guides the recording material to a second transport path toward a toner image forming unit that forms a toner image on a surface opposite to a surface of the recording material, where the toner is fixed, which is reversed and transported from the transport unit.

11. A fixing device comprising:

a fixing member that fixes toner onto a recording material;

a pressurizing member that forms a nip portion, through which the recording material passes, between the fixing member and the pressurizing member;

a moving member that is disposed to be movable in response to passage of the recording material in a transport path of the recording material which passes through the nip portion;

a detection unit that detects a presence or absence of the moving member;

a displacement mechanism that changes a position of the pressurizing member with respect to the fixing member;

a housing supporting the displacement mechanism and the moving member;

an insertion port into which an attachment/detachment member that is disposed in a detachable manner at a position to contact the displacement mechanism, the housing and the moving member is inserted; and an insertion recognition unit that recognizes a presence or absence of the attachment/detachment member which is inserted into the insertion port according to a state of the moving member detected by the detection unit.

12. An image forming apparatus comprising:

a toner image forming unit that forms a toner image onto a recording material;

a fixing member that fixes the toner image formed by the toner image forming unit onto the recording material;

a pressurizing member that forms a nip portion, through which the recording material passes, between the fixing member and the pressurizing member;

a moving member that is disposed to be movable in response to passage of the recording material in a transport path of the recording material which passes through the nip portion;

a detection unit that detects a presence or absence of the moving member;

a displacement mechanism that changes a position of the pressurizing member with respect to the fixing member;

a housing supporting the displacement mechanism and the moving member;

an attachment/detachment member that is disposed in a detachable manner at a position to contact the displacement mechanism, the housing and the moving member; and an attachment/detachment recognition unit that recognizes an attachment/detachment state of the attachment/detachment member according to a state of the moving member which is detected by the detection unit.

* * * * *